US006367743B1

(12) United States Patent
Iannelli

(10) Patent No.: US 6,367,743 B1
(45) Date of Patent: Apr. 9, 2002

(54) ANCHORING BRACKET FOR A GUTTER COVER

(76) Inventor: Anthony Iannelli, 1140 Pamela Dr., Cincinnati, OH (US) 45255

( * ) Notice: Subject to any disclaimer, the term of this patent is extended or adjusted under 35 U.S.C. 154(b) by 0 days.

(21) Appl. No.: 09/493,726

(22) Filed: Jan. 28, 2000

Related U.S. Application Data

(60) Provisional application No. 60/117,783, filed on Jan. 29, 1999.

(51) Int. Cl.[7] ..... E04D 13/072

(52) U.S. Cl. ..... 248/48.2; 52/12; 248/48.1

(58) Field of Search ..... 248/48.2, 48.1, 248/228.3, 220.21, 231.91, 300; 52/11, 12; 405/119

(56) References Cited

U.S. PATENT DOCUMENTS 2,710,159 A * 6/1955 Gordon ..... 248/48.2
3,333,803 A * 8/1967 Landis ..... 248/48.2
4,071,976 A * 2/1978 Chernewski ..... 248/311.1
5,016,404 A * 5/1991 Briggs ..... 52/12
5,271,192 A * 12/1993 Nothum, Sr. et al. ..... 52/12
5,345,727 A * 9/1994 McCrea ..... 52/11
6,016,631 A * 1/2000 Lowrie, III ..... 52/12
6,168,125 B1 * 1/2001 Winger et al. ..... 248/228.3

* cited by examiner

*Primary Examiner*—Ramon O. Ramirez
*Assistant Examiner*—Tan Le
(74) *Attorney, Agent, or Firm*—Wm. Cates Rambo

(57) ABSTRACT

A top flange extends over a portion of the roof overhanging the gutter and is formed with a fastener-receiving bore for securing the gutter cover thereto. A riser web extends downwardly from the top flange, and a return web extends inwardly from the riser web. The top flange, riser web and return web define an overhang-receiving space. A shoulder web extends downwardly from the return web and is formed with a fastener-receiving bore for securing the shoulder web to a back wall of the gutter.

14 Claims, 4 Drawing Sheets

ANCHORING BRACKET FOR A GUTTER COVER

RELATED APPLICATION

A claim is hereby made to the benefit of U.S. Provisional Application No. 60/117,783 filed Jan. 29, 1999.

BACKGROUND OF THE INVENTION

The present invention relates to roof gutter covers and more particularly to anchoring brackets for securing the cover to the gutter and to roof structures adjacent to the gutter.

Roof gutter covers, such as those sold and installed under the mark GUTTER TOPPER® by Gutter Topper Ltd. of Amelia Ohio, are elongated sheet metal structures designed to prevent leaves and other debris from entering the trough portions of roof gutters. Typically, such covers are equipped with a longitudinally extending, roof-engaging flange. When the cover is installed, a leading portion of the roof-engaging flange is inserted under a course or row of roof shingles, a slotted or perforated body portion of the cover is positioned over the elongated, water-receiving mouth of the gutter and an outer longitudinally extending and relatively convoluted portion of the cover is mounted on the outer lip of the gutter. In those instances where the shingles are relatively flexible, such as newly installed asphalt shingles which have been heated by the sun, the free edges of the shingles overlying the leading edge of the roof-engaging flange are lifted and the installer nails the leading edge in place. However, when the shingles are rigid, such as those formed from slate, wood or clay or asphalt shingles which are old or cold, they cannot be lifted sufficiently to nail the leading edge of roof engaging flange without fracturing or otherwise damaging some of the shingles. Thus, the present inventor was faced with the problem of securing the roof engaging flange of a gutter cover in those instances where the flange could not be nailed to the existing roof without jeopardizing the shingles.

SUMMARY OF THE INVENTION

A bracket according to the present invention is adapted for attachment to a roof gutter and to a gutter cover and for use where the roof has a portion overhanging the gutter. The present bracket basically comprises a cover mounting flange, a riser web, a return web and a gutter-engaging web. The cover mounting flange has a free end. The riser web extends from an end of the cover mounting flange opposite the free end thereof. The return web extends from an end of the riser web opposite the cover mounting flange and is disposed in spaced, generally centered relation to the cover mounting flange. The gutter-engaging web extends from an end of the return web opposite the riser web. The cover mounting flange, the riser web and the return web are sized and positioned to receive the portion of the roof overhanging the gutter when the gutter-engaging web is mounted on the gutter.

DETAILED DESCRIPTION OF THE PREFERRED EMBODIMENTS

Figure 1:
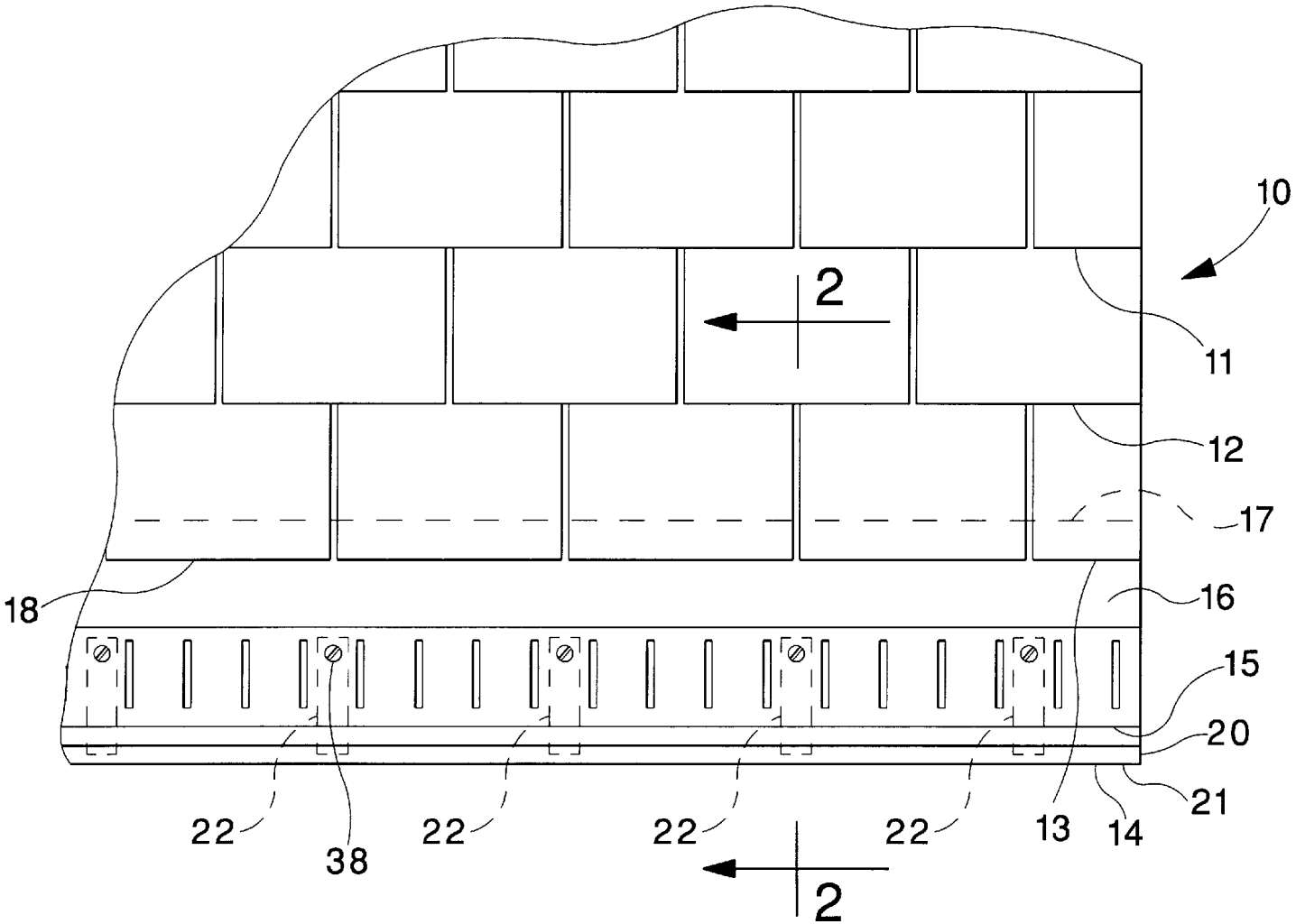
FIG. 1 is a fragmentary top plan view of a gutter, a gutter cover and a lower portion of a shingled roof with a plurality of a first embodiment of the present anchoring bracket (shown in phantom lines) disposed in operative positions there.
Figure 2:
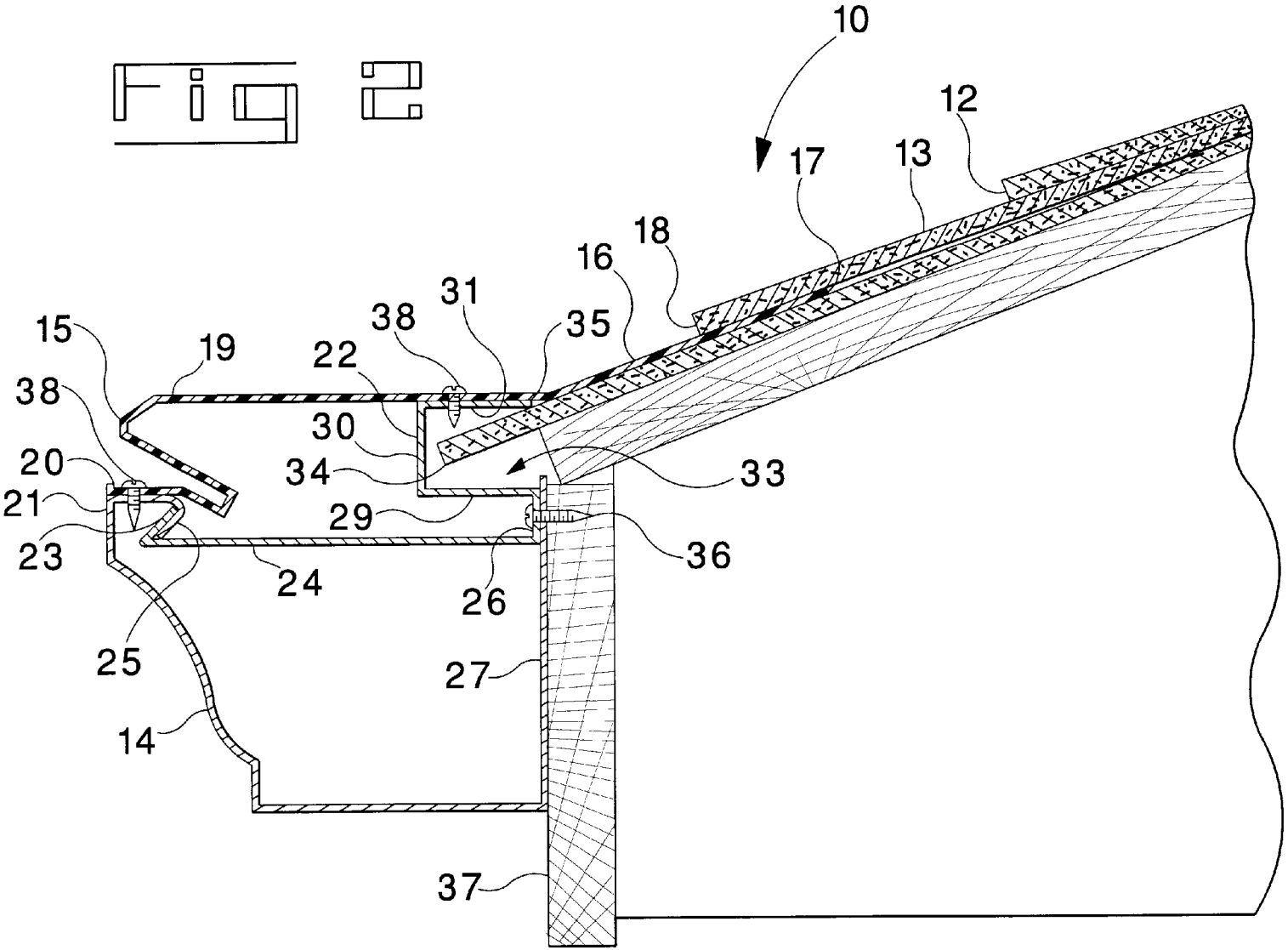
FIG. 2 is an enlarged vertical sectional view taken along line 2—2 of FIG. 1 and particularly illustrates the preferred manner in which the first embodiment of sent anchoring bracket is positioned and secured into place.
Figure 4:
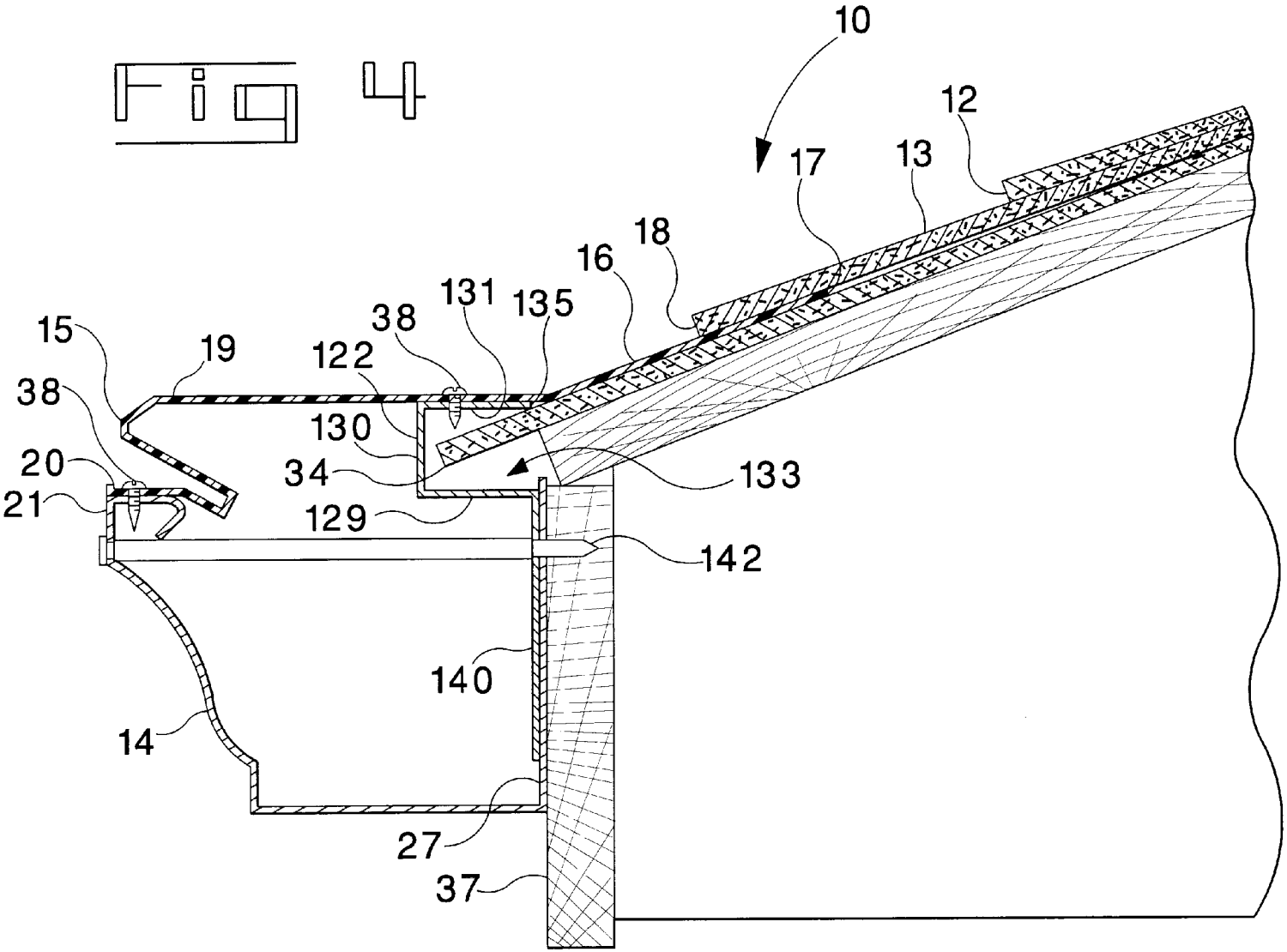
FIG. 4 a vertical sectional view similar to FIG. 2 and particularly illustrates the preferred manner in which a second embodiment of the present anchoring bracket is positioned and secured into place.

As illustrated in FIGS. 1, 2 and 4, a lower portion of a roof, generally designated 10, is equipped with several courses of shingles 11, 12, 13. An elongated gutter 14 extends along a lowermost edge of the roof 10, and an elongated gutter cover 15 is disposed in overlying relation to the gutter 14. The gutter cover 15 is formed with a longitudinally extending roof-engaging flange 16, and a leading edge 17 of the roof-engaging flange 16 extends under a free end 18 of the adjacent course of shingles 13. A slotted, generally planar body portion 19 of the gutter cover 15 extends over the gutter 14, and a relatively convoluted front section 20 of the cover is mounted on a front lip 21 of the gutter 14.

As illustrated in FIG. 1, a plurality of relatively spaced apart anchoring brackets 22 according to a first embodiment of the present invention extend from the front lip 21 of the gutter to a position on the slotted body 19 of the cover adjacent to the roof-engaging flange 16. Preferably, each of the anchoring brackets 22 is integrally and unitarily formed from a moderately bendable aluminum alloy material.

Figure 3:
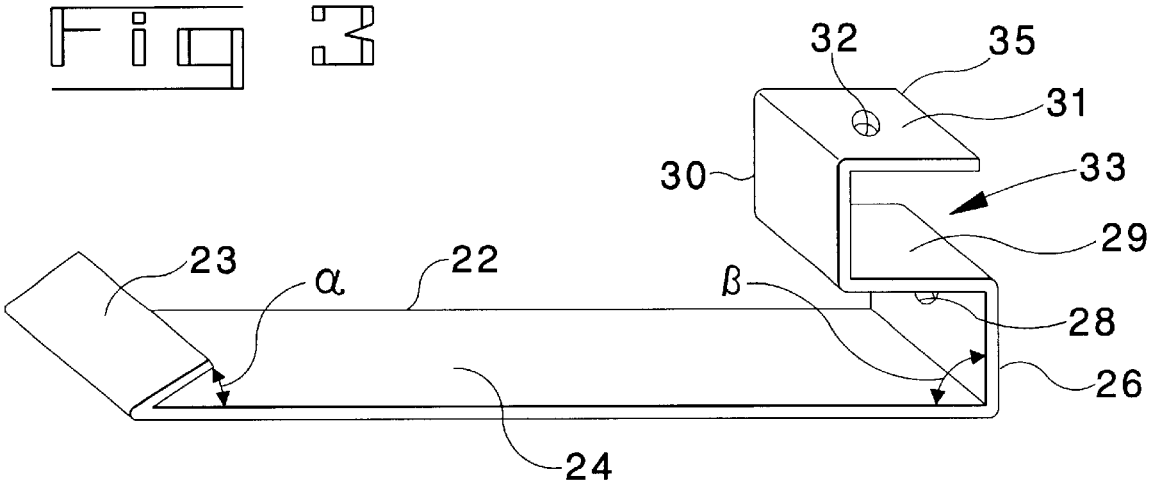
FIG. 3 is a further enlarged isometric view of the first embodiment of the present anchoring bracket.

As illustrated in FIGS. 2 and 3, the present anchoring bracket 22 is formed with a relatively in-turned flange 23 which projects upwardly at an acute angle $\alpha$ from one end of a relatively elongated and flat arm 24. The angle $\alpha$ between the in-turned flange 23 and the flat arm 24 is less than 70° and more than 10° and is preferably 45°±10°. The flange 23 and the angle $\alpha$ are sized so that the flange may be mounted on a down turned free edge 25 of the gutter lip 21. At an end of the flat arm 24 opposite the lip-engaging flange 23 is an upwardly projecting shoulder web 26. The length of the flat arm 24 is such that, with the in-turned flange 23 mounted on the down turned free edge 25 of the gutter lip 21, the shoulder web 26 is disposed at or near a back wall 27 of the gutter 14. The shoulder web 26 extends upwardly from the flat arm 24 at an angle $\beta$ which is 90°±10°. Preferably, the shoulder web 26 is provided with a fastener-receiving bore 28 extending therethrough. At an end of the shoulder web 26 opposite the flat arm 24 is a generally horizontal return web 29. At an end of the return web 29 opposite the gutter-mounting web 26 is a vertically extending riser web 30. At an end of the riser web 30 opposite the return web 29 is a horizontally extending top flange 31. Preferably, the top flange 31 is provided with a fastener-receiving bore 32. The top flange 31, riser web 30 and return web 29 define a generally U-shaped end, generally designated 33, of the anchoring bracket 22. The top flange 31, riser web 30 and return web 29 are sized and angled relative to one another so that the U-shaped end 33 may be positioned in surrounding relation to a portion 34 of a lowermost course of shingles and/or flashing which overhangs the gutter 14. Preferably, the top flange 31 is of such a length that a free end 35 thereof rests upon an upper surface of the overhanging portion 34 adjacent to an interface between the slotted body 19 and the roof-engaging flange 16 of the gutter cover 15.

Once the anchoring bracket 22 has been dimensioned, shaped and angled in the above-described fashion, it is mounted on the gutter 14. First, the in-turned flange 23 is mounted on the downturned end 25 of the gutter lip 21, and the U-shaped end 33 is positioned in surrounding relation to the overhang 34. Then, a wood screw or other fastener 36 is secured through the bore 28 in the shoulder web 26 and the back gutter wall 27 into a fascia board 37 or other roof structure disposed on the opposite side of the back gutter wall 27. Next, the convoluted front section 20 of the gutter cover 15 is positioned on the gutter lip 21. Machine screws 38 or other fasteners secure the front cover section 20 to the gutter lip, as well as securing the slotted body 19 adjacent to the roof-engaging flange 16 to the top flange 31 of the anchoring bracket 22.

Figure 5:
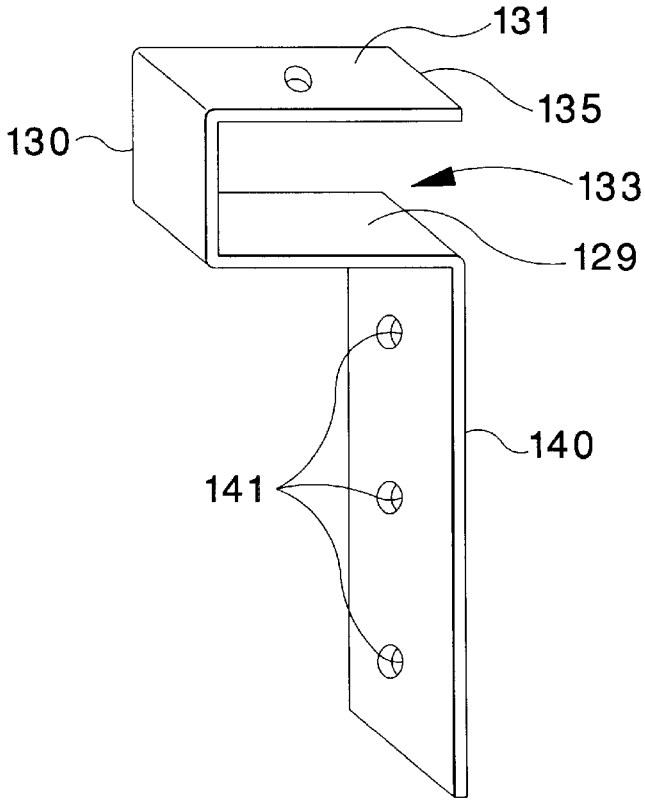
FIG. 5 is a further enlarged isometric view of the second embodiment of the present anchoring bracket.

As illustrated in FIGS. 4 and 5, a plurality of anchoring brackets 122 according to a second embodiment of the present invention may be fashioned and used to secure the gutter cover 15 to the gutter 14. Preferably, each of the anchoring brackets 122 is integrally and unitarily formed from a moderately bendable aluminum alloy material. The anchoring bracket 122 is formed with a generally U-shaped end, generally designated 133, comprising a top flange 131, a riser web 130 and a return web 129 which are sized and angled relative to one another so that the U-shaped end 133 may be positioned in surrounding relation to the overhanging portion 34 of a lowermost course of shingles and/or flashing. Preferably, the top flange 131 is of such a length that a free end 135 thereof rests upon an upper surface of the overhanging portion 34 adjacent to an interface between the slotted body 19 and the roof-engaging flange 16 of the gutter cover 15. At an end of the return web 129 opposite the riser web 130 is a downwardly extending, elongated shoulder 140. The return web 129 is of such a length that the elongated shoulder 140 is disposed on or near the back gutter wall 27. Preferably, at least one fastener-receiving bore 141 is formed in the shoulder 140.

Once the anchoring bracket 122 has been dimensioned, shaped and angled in the above-described fashion, it is mounted on the gutter 14. First, the elongated shoulder 140 is positioned on the back gutter wall 27, and a gutter pin 142 or other fastener is secured through one of the bores 141 in the shoulder 140 and the back gutter wall 27 into a fascia board 37 or other roof structure disposed on the opposite side of the back gutter wall 27. Next, the U-shaped end 133 is positioned in surrounding relation to the overhang 34. Then, the convoluted front section 20 of the gutter cover 15 is positioned on the gutter lip 21. Machine screws 38 or other fasteners secure the front cover section 20 to the gutter lip 21, as well as securing the slotted body 19 adjacent to the roof-engaging flange 16 to the top flange 131 of the anchoring bracket 122.

While two preferred embodiments of the present anchoring bracket have been illustrated and described in substantial detail, the foregoing disclosure is not intended to limit unduly the spirit of the invention or the scope of the following claims.

I claim:

1. A bracket adapted for attachment to a roof gutter and to a gutter cover, said roof having a portion overhanging said gutter, said bracket comprising:

a top flange having a free end;

a riser web extending from an end of the top flange opposite the free end thereof;

a return web extending from an end of the riser web opposite the top flange, said return web being disposed in spaced, generally centered relation to said top flange;

a shoulder web extending from an end of the return web opposite the riser web;

said top flange, riser web and return web defining an overhang-receiving recess adapted to receive the portion of the roof overhanging the gutter; and said top flange, riser web, return web and shoulder web being formed so that, with the overhanging portion of the roof extending into said overhang-receiving recess, said shoulder web is disposed to engage a rear portion of the gutter and said top flange is disposed to engage the gutter cover.

2. The bracket according to claim 1, wherein the shoulder web is longer than any of the top flange, riser web and return web.

3. The bracket according to claim 1, wherein the shoulder web is formed with a free end opposite the return web.

4. The bracket according to claim 1, wherein a fastener-receiving bore is provided in each of the top flange and the shoulder web.

5. The bracket according to claim 1, wherein the top flange, riser web, return web and shoulder web are integrally and unitarily formed thereon.

6. the bracket according to claim 1, wherein the riser web is disposed at a substantially right angle to the top flange, the return web is disposed at a substantially right angle to the riser web and the shoulder web is disposed at a substantially right angle to the return web.

7. The bracket according to claim 1, which further comprises an elongated arm extending from an end of the shoulder web opposite the return web, said elongated arm being disposed in spaced, generally parallel relation to the return web.

8. The bracket according to claim 7, wherein the elongated arm extends generally perpendicularly away from the shoulder web.

9. The bracket according to claim 7, which further comprises an in-turned flange extending from an end of the elongated arm opposite the shoulder web.

10. The bracket according to claim 9, wherein the in-turned flange is angled generally towards the riser web.

11. The bracket according to claim 1, wherein, with the overhanging portion of the roof extending into the overhang-receiving recess of said bracket, the top flange, except for the free end thereof, is disposed in spaced relation to the outer surface of the roof.

12. The bracket according to claim 1, wherein, with the overhanging portion of the roof extending into the overhang-receiving recess of said bracket, the top flange, except for the free end thereof, extends obliquely from the roof.

13. The bracket according to claim 1, wherein, with the overhanging portion of the roof extending into the overhang-receiving recess of said bracket, the top flange, except for the free end thereof, extends generally horizontally from the roof.

14. The bracket according to claim 1, wherein, with the overhanging portion of the roof extending into the overhang-receiving recess of said bracket, the free end of said top flange is disposed to rest upon an outer surface of the roof.

* * * * *